US005885110A

United States Patent [19]

Ensz et al.

[11] Patent Number: 5,885,110

[45] Date of Patent: Mar. 23, 1999

[54] SNAP TOGETHER SPRING BLOCK AND METHOD

[75] Inventors: Lydon Ensz, Omaha, Nebr.; William Spitz, Indianapolis, Ind.; Dean Davis, Omaha, Nebr.

[73] Assignee: Lucent Technologies Inc., Murray Hill, N.J.

[21] Appl. No.: 814,396

[22] Filed: Mar. 11, 1997

[51] Int. Cl.[6] ..... H01R 23/02

[52] U.S. Cl. ..... 439/676

[58] Field of Search ..... 439/676, 660, 439/885, 752

[56] References Cited

U.S. PATENT DOCUMENTS

| | | | |
|---|---|---|---|
| 3,699,498 | 10/1972 | Hardesty et al. . | |
| 3,850,497 | 11/1974 | Krumreich et al. . | |
| 4,618,207 | 10/1986 | Silbernagel | 439/676 OR |
| 4,820,192 | 4/1989 | Denkmann et al. | 439/404 |
| 5,096,442 | 3/1992 | Arnett et al. | 439/676 |
| 5,118,311 | 6/1992 | Margini | 439/676 OR |
| 5,118,312 | 6/1992 | Lu | 439/676 OR |

*Primary Examiner*—Paula Bradley
*Assistant Examiner*—Daniel Wittels

[57] ABSTRACT

A snap together spring block enables the reliable capture, formation and support of metallic conductors known as lead frames. First and second body halves are designed to mate forming the complete spring block. Each body half incorporates a plurality of cavities and projections, similar to hills and valleys. The cavities and projections can be designed to fit various configurations of lead frames. Integrally molded or formed into one of the body halves is an internal attachment mechanism, such as a clip, which is designed to fit an internal recess molded into the second body half, or mating half, of the spring block for mating the two halves. The plurality of cavities and projections are alternately spaced such that when the first body half is mated to the second body half, the projections are received within the cavities forming a plurality of apertures. Because each half contains both cavities and projections, a plurality of planes are formed when the mating halves are joined, in which lead frames are interposed. The conductors are supported such that they remain rigidly fixed relative to each other. Formed into external surface of second body half is a radius and parallel channels adapted to receive the metallic conductors of the lead frames when the metallic conductors are formed downwardly and rearwardly around the radius of the external surface of the second body half.

7 Claims, 3 Drawing Sheets

SNAP TOGETHER SPRING BLOCK AND METHOD

FIELD OF THE INVENTION

The present invention relates generally to electrical connector blocks used in the telephony industry, and more particularly, to a snap together spring block and method that allow the reliable capture, formation and support of resilient metallic conductors known as lead frames.

BACKGROUND OF THE INVENTION

In telephony wiring, the need frequently arises for the capture and support of metallic conductors within a dielectric supporting device known as a "spring block." The metallic conductors are typically part of an assembly known as a lead frame. Prior art spring blocks use a variety of techniques to bond the dielectric material in order to support the lead frame in the proper relationship. For example, ultrasonic bonding is a technique used to join components of prior art spring blocks and is disclosed in U.S. Pat. No. 3,699,498, which issued on Oct. 17, 1972 to Hardesty et al. and U.S. Pat. No. 5,096,442, which issued on Mar. 17, 1992 to Arnett et al. This technique, as described in the foregoing documents, requires the application of an ultrasonic wave to a spring block, which deforms the material of the spring block, thus joining the components.

Prior art spring blocks also use a technique in which a metallic conductor is inserted through an orifice in the spring block and then formed to the desired shape. This technique is disclosed in U.S. Pat. No. 3,850,497, which issued on Nov. 26, 1974 to Krumreich et al.

The prior art techniques fail to provide a reliable, compact, and simple mode of support and isolation of the metallic conductors of the lead frame. While other prior art spring blocks disclose a snap together mode of attachment, they fail to provide a variable conductor mounting surface that can accommodate various shapes and patterns of lead frames. For example, see U.S. Pat. No. 4,820,192, which issued on Apr. 11, 1989 to Denkmann et al.

SUMMARY OF THE INVENTION

The present invention provides for a snap together spring block and method that allow reliable capture, formation and support of resilient metallic conductors known as lead frames.

In architecture, the snap together spring block is a two-piece structure comprising first and second body halves, each of which is preferably produced from a generally nonconducting dielectric material. The first and second body halves are designed to mate, thus forming the complete spring block. Each body half incorporates a plurality of cavities and projections on an internal surface, similar to hills and valleys. The cavities and projections can be designed to fit various shapes and patterns of lead frames. The second body half incorporates a radiused front lower edge around which, and parallel channels into which metallic conductors are formed. Lead frames are metallic conductor strips that conduct electrical signals from, for example, a telephone line cord connected to a residential telephone to the premises wiring belonging to the telephone company. The lead frames are manufactured as elongated parallel elements, which form the resilient metallic conductors, that are held together during the installation in the spring block with an integral transverse strip connecting all leads in the lead frame. After installation in the spring block, the transverse strip is removed, leaving a plurality of electrically isolated metallic conductors. The spring block retains these metallic conductors in a parallel configuration while isolating them from each other. The individual metallic conductors are predominately rectangular in cross section, but have protrusions extending transversely where they interface with the spring block. These protrusions permit a broader contact surface with which to engage the projections and cavities of the spring block, providing additional mechanical stability. These protrusions also are designed to affect the impedance of the electrical contact such that electrical crosstalk between adjacent conductors is minimized. The elongated contact portion of the lead frame is designed as an upper lead frame and a lower lead frame. The metallic conductors of the upper lead frame are slightly longer than the metallic conductors of the lower lead frame. This is to allow the upper metallic conductors to extend the same distance as the metallic conductors of the lower lead frame after the conductors are formed around the lower surface of the spring block. The first body half is symmetrical in design, thus simplifying assembly by allowing either front to rear orientation.

Integrally molded or formed into one of the body halves is an internal attachment mechanism, or clip, which is designed to fit an internal recess molded into the second body half, or mating half, of the spring block for mating the two halves. The internal attachment clips extend longitudinally from a front surface of the spring block to the opposite, or rear surface on either side of the first body half. Similarly, the internal recesses which receive the clips are integrally molded on the second body half, and extend longitudinally from a front surface to the opposite, or rear surface on either side of the second body half.

The plurality of cavities and projections on the inside surface of each spring block body half are alternately spaced such that when the first body half is mated to the second body half, the projections are received within the cavities forming a plurality of apertures. The cavities and projections extend longitudinally from a front surface of the spring block to the opposite, or rear surface. Because each half contains both cavities and projections, a plurality of planes are formed when the mating halves are joined, in which resilient lead frames are interposed. The conductors are supported such that they remain rigidly fixed relative to and electrically isolated from one another. The projections and cavities are designed such that the metallic conductors of the upper and lower lead frames are staggered resulting in the capture of all conductors in an alternating axial pattern.

Integrally molded into the external surface of the second body half is a radius and parallel adjacent channels which extend longitudinally from the rear surface of the second body half to the front edge of the second body half. The radius, which forms to front lower edge of the second body half, is designed to allow the formation of metallic conductors around the outer surface of the second body half without the use of any external tooling, and the channels are designed to receive the metallic conductors after the conductors are formed around the second body half.

Once the lead frames are captured within the spring block, the leads are formed around the second body half such that the leads extend downward and rearward. A small portion of the metallic conductor extends axially outwardly from the assembled spring block at the end opposite that of the formed end. These axial extensions of the metallic conductor are designed to be received within the holes of a printed wiring board at a higher assembly level. At this time, the integral transverse strip that retains the lead frame metallic conductors in proper relation to each other is removed. The formed metallic conductors fit into parallel channels formed into the external surface of the second body half, the channels separating the conductors in order to prevent the conductors from contacting each other.

The projections and cavities on the internal surfaces of the spring block body halves can be configured in a variety of dimensions in order to accommodate various shapes and patterns of lead frames. For example, the elongations on the metallic conductors can be of a variety of shapes and patterns depending upon the impedance required. This will require the protrusions and cavities of the spring block to match the pattern of the metallic conductors.

The invention has numerous advantages, a few of which are delineated hereafter, as merely examples.

An advantage of the snap together spring block is that it allows the capture, formation and support of resilient lead frames using a simple snap together assembly technique.

Another advantage of the present invention is that the first body half of the spring block is symmetrical and can be assembled in either front to rear orientation, thus simplifying assembly.

Another advantage of the snap together spring block is that it simplifies the connection process by eliminating the need for a complicated attachment process such as ultrasonic welding or insert molding.

Another advantage of the snap together spring block is that it is simple in design, reliable in operation, and its use can be easily implemented using a simple continuous motion machine.

Other objects, features, and advantages of the present invention will become apparent to one with skill in the art upon examination of the following drawings and detailed description. It is intended that all such additional objects, features, and advantages be included herein within the scope of the present invention, as defined in the appended claims.

BRIEF DESCRIPTION OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION OF THE PREFERRED EMBODIMENT

Figure 1:
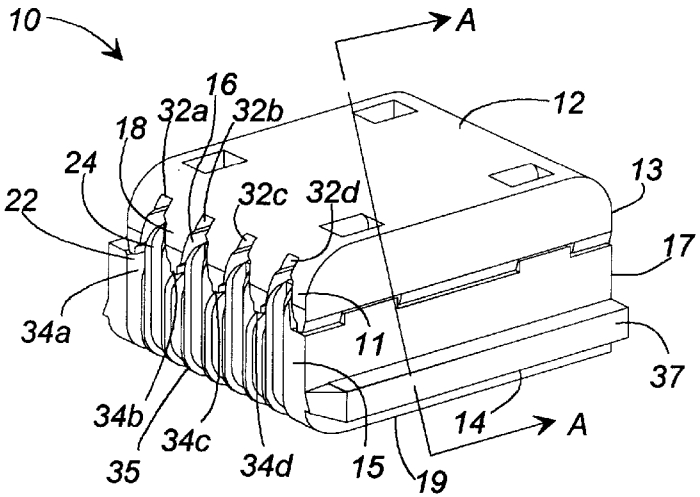
FIG. 1 is an isometric view of a snap together spring block of the present invention with mating halves connected.

Referring now to FIG. 1, shown is an isometric view of the snap together spring block 10 of the present invention in the closed position, that is, with both first body half 12 matably engaged to second body half 14. Projection 18 of first body half 12 fits into cavity 22 of second body half 14. Similarly, projection 24 of second body half 14 fits into cavity 16 of first body half 12. This results in the formation of aperture 32 in first body half 12, and aperture 34 in second body half 14, into which metallic conductors, known in the industry as lead frames, are received. Rib 37 which is formed on either side of second body half 14 is designed to engage a mating recess in a mating connector which is not part of the instant invention. Rib 37 is a keying feature which permits the proper alignment of the mating connector prior to the electrical engagement of the metallic conductors, thus allowing proper alignment and electrical connection of conductors. Also shown in FIG. 1 is section line A—A which forms the perspective for FIGS. 2A and 2B.

Figure 3:
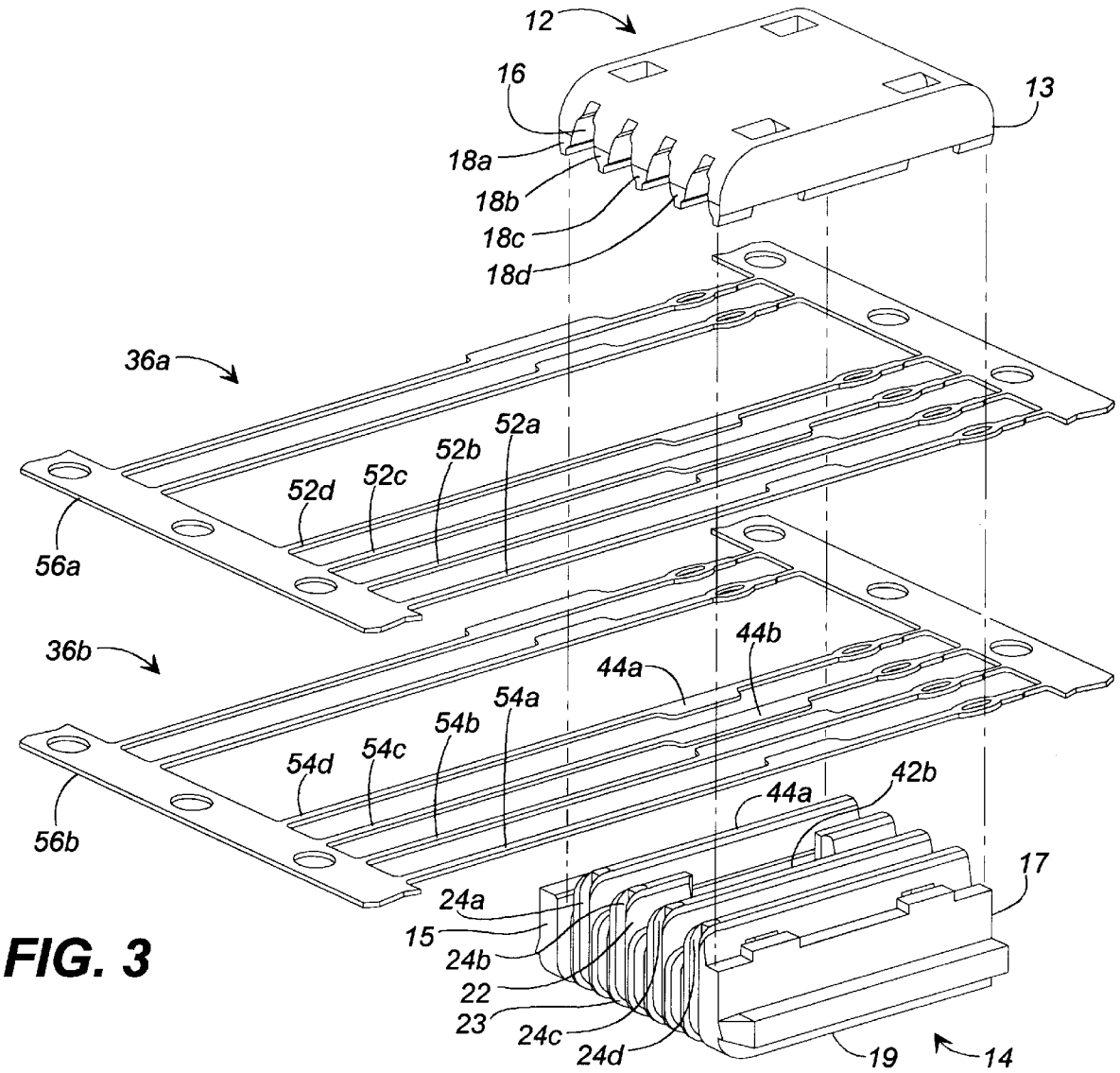
FIG. 3 is an exploded isometric view of the snap together spring block of FIG. 1 in an open position, showing the interposition of a lead frame.

Referring to FIG. 3, the lead frame will be described in detail. Upper lead frame 36*a* is comprised of a series of parallel elongated metallic conductors 52*a*, 52*b*, 52*c* and 52*d*. Lower lead frame 36*b* is comprised of a series of parallel elongated metallic conductors 54*a*, 54*b*, 54*c* and 54*d*. Transverse strip 56*a* retains metallic conductors 52*a*, 52*b*, 52*c* and 52*d* of upper lead frame 36*a* in proper parallel relation, increasing stability of the lead frame. Similarly, transverse strip 56*b* retains metallic conductors 54*a*, 54*b*, 54*c* and 54*d* of lower lead frame 36*b* in proper parallel relation, increasing stability of the lead frame. The transverse strips are removed after the lead frames are captured in the spring block. Also part of the metallic conductors of the lead frames are elongated sections 44*a* and 44*b*. For simplicity, we will only refer to two elongated sections on two metallic conductors, however all metallic conductors possess these elongated sections. Elongated sections 44*a* and 44*b* are shaped to provide improved mechanical stability in the area where the metallic conductor meets the spring block and will be discussed in detail below. Elongated sections 44*a* and 44*b* are also designed to affect the impedance of the circuit in which inserted in order to minimize the electrical crosstalk between adjacent metallic conductors of the lead frame.

The following preferred embodiment of the present invention will be described referring to the spring block as depicted in the drawings, which will provide eight apertures into which two lead frames containing four metallic conductors each are interposed. However, any number of metallic conductors, and various profiles of lead frames can be captured and supported using the concepts of the present invention by varying the shape and size of the spring block.

Figure 2A:
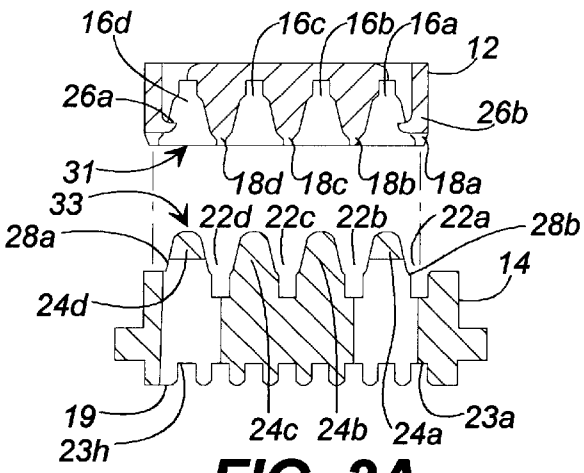
FIG. 2A is a profile view of the snap together spring block of FIG. 1 taken along section line A—A, showing the spring block in an open position.

FIG. 2A shows a profile view of the snap together spring block 10 of FIG. 1 in the open position, taken along section line A—A. Projections 18*a*, 18*b*, 18*c* and 18*d* and cavities 16*a*, 16*b*, 16*c* and 16*d* on internal surface 31 of first body half 12, and projections 24*a*, 24*b*, 24*c* and 24*d* and cavities 22*a*, 22*b*, 22*c* and 22*d* on internal surface 33 of second body half 14 are depicted. As can be seen, projections 18*a*, 18*b*, 18*c* and 18*d* of first body half 12 and projections 24*a*, 24*b*, 24*c* and 24*d* of second body half 14 are dissimilar in profile, thus facilitating formation of apertures 32*a*, 32*b*, 32*c* and 32*d* and apertures 34*a*, 34*b*, 34*c* and 34*d* shown in FIG. 1. First body half 12 is symmetrical in shape allowing ease of assembly in either front to rear orientation.

With reference to FIG. 2A, internal attachment clips 26*a* and 26*b* are integrally molded as part of first body half 12. The internal attachment clips extend longitudinally from a first surface 11 to a second surface 13 of first body half 12, and along both sides of first body half 12. Internal attachment clips 26*a* and 26*b* are designed to mate with internal attachment recesses 28*a* and 28*b* which are integrally molded into the outermost projections 24*a* and 24*d* of second body half 14. Internal attachment recesses 28*a* and 28*b* extend longitudinally from a first surface 15 to a second surface 17 of second body half 14, and along both sides of second body half 14.

Figure 5:
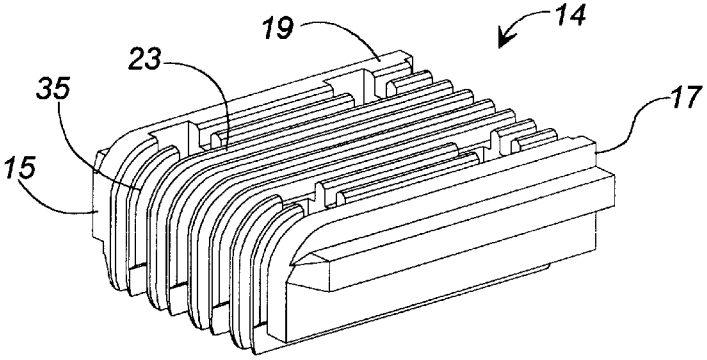
FIG. 5 is an isometric view of the lower surface of the second body half of the snap together spring block of FIG. 1.

Referring now to FIG. 5, shown is the lower surface 19 of second body half 14. Integrally molded into lower surface 19 of second body half 14 are radius 35 and parallel channels 23*a* through 23*h*. Radius 35 forms the front lower edge of lower surface 19 of second body half 14. Parallel channels 23*a* through 23*h* are formed to longitudinally extend from first surface 15 of second body half 14 to second surface 17 of second body half 14. Parallel channels 23*a* through 23*h* are formed so as to axially accommodate individual metallic conductors 52*a*–52*d* and 54*a*–54*d* of lead frames 36*a* and 36*b* when the individual conductors 52*a*–52*d* and 54*a*–54*d* are formed around radius 35 of lower surface 19 of second body half 14 so as to extend downward and rearward. Parallel channels 23*a*–23*h* isolate metallic conductors 52*a*–52*d* and 54*a*–54*d* from one another and prevent contact. Parallel channels 23*a*–23*h* are also designed such that they capture and guide metallic conductors 52*a*–52*d* and 54*a*–54*d* during the lead forming process which will be discussed later in detail.

Figure 2B:
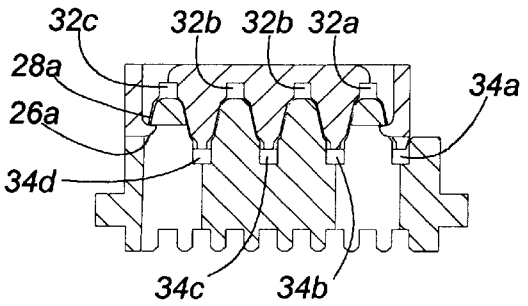
FIG. 2B is a profile view of the snap together spring block of FIG. 1 taken along section line A—A, showing the spring block in a closed position.

FIG. 2B illustrates a profile view of the snap together spring block of FIG. 1 in the closed position. Projections 18*a*, 18*b*, 18*c* and 18*d* of first body half 12 are received into cavities 22*a*, 22*b*, 22*c* and 22*d* respectively of second body half 14, thus forming apertures 34*a*, 34*b*, 34*c* and 34*d* in second body half 12. Similarly, projections 24*a*, 24*b*, 24*c* and 24*d* of second body half 14 are received into cavities 16*a*, 16*b*, 16*c* and 16*d* of first body half 12, thus forming apertures 32*a*, 32*b*, 32*c* and 32*d* in first body half 12. The profile of apertures 32*a*, 32*b*, 32*c* and 32*d*, and apertures 34*a*, 34*b*, 34*c* and 34*d* are designed such that a metallic conductor is rigidly supported therein.

Referring now to FIG. 3, shown is an exploded isometric view of the snap together spring block 10 of FIG. 1 in an open position showing the interposition of lead frames 36*a* and 36*b* having metallic conductors 52*a*–54*d* and 54*a*–54*d*. Projection 18 of first body half 12 and projection 24 of second body half 14 can be designed to accommodate a variety of metallic conductor shapes. Projection 24 extends longitudinally from a first surface 15 to a second surface 17 which comprises the entire length of second body half 14 and can be designed with recesses 42*a* and 42*b* of various profiles to accommodate metallic conductor 36*b* having a variety of elongated sections of various shapes and patterns. For example, elongated sections 44*a* and 44*b* are profiles of metallic conductor 36*b* that can be accommodated by second body half 14 having projections 24*a* and 24*b* with recesses 42*a* and 42*b*. Similarly, first body half 12 can be provided with projections 18*a* and 18*b* having recesses similar to that of projections 24*a* and 24*b* of second body half 14 in order to accommodate various profiles of metallic conductor 36*a*.

Figure 4:
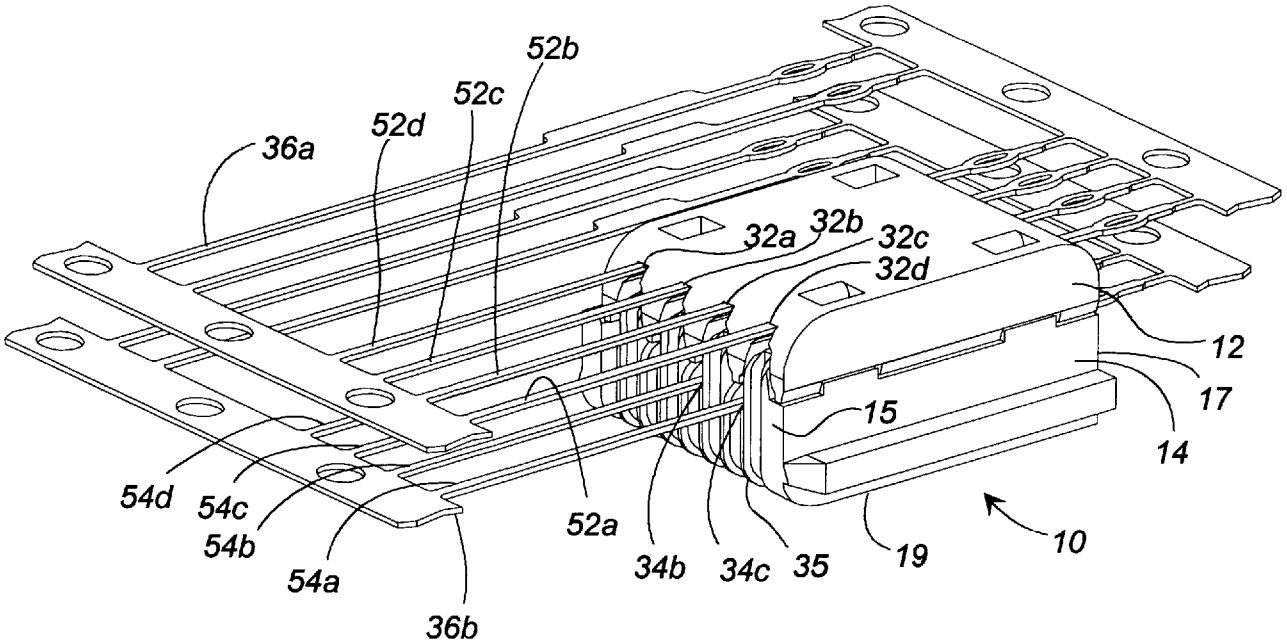
FIG. 4 is an isometric view of the snap together spring block of FIG. 1 in a closed position, showing the interposition of a lead frame.

FIG. 4 shows an isometric view of the snap together spring block 10 of FIG. 1 in a closed position showing the interposition of lead frames 36*a* and 36*b* having metallic conductors 52*a*–52*d* and 54*a*–54*d*. Projections 24*a*, 24*b*, 24*c* and 24*d* (See FIG. 2A) of second body half 14, when received into cavities 16*a*, 16*b*, 16*c* and 16*d* (See FIG. 2A) of first body half 12, form a series of apertures 32*a*, 32*b*, 32*c* and 32*d* into which lead frame 36*a* is interposed. Apertures 32*a*, 32*b*, 32*c* and 32*d* reside on a first plane formed on first surface 11 of first body half 12 and extend longitudinally through to second surface 13 of first body half 12. Similarly, projections 18*a*, 18*b*, 18*c* and 18*d* (See FIG. 2A) of first body half 12, when received into cavities 22*a*, 22*b*, 22*c* and 22*d* (See FIG. 2A) of second body half 14, form a series of apertures 34*a*, 34*b*, 34*c* and 34*d* into which lead frame 36*b* is interposed. Apertures 34*a*, 34*b*, 34*c* and 34*d* reside on a second plane formed on first surface 15 of second body half 14 and extend longitudinally through to second surface 17 of second body half 14. Once captured, metallic conductors 52*a*–52*d* and 54*a*–54*d* of lead frames 36*a* and 36*b* are supported in an electrically isolated alternating axial position. This position allows metallic conductors 52*a*–52*d*, and 54*a*–54*d* to be formed downwardly and rearwardly around radius 35 of lower surface 19 of second body half 14, into channels 23*a* through 23*h* (See FIG. 2A).

Operation of the spring block 10 will now be described. Referring now to FIG. 2A and FIG. 3, metallic conductor 36*a* is laid into cavities 16*a*, 16*b*, 16*c* and 16*d* of first body half 12 and metallic conductor 36*b* is laid into cavities 22*a*, 22*b*, 22*c* and 22*d* of second body half 14. First and second body halves are fitted together and secured with internal attachment clip 26*a* engaging internal attachment recess 28*a* and internal attachment clip 26*b* engaging internal attachment recess 28*b*. Once assembled together, first and second body halves of the snap together spring block 10 firmly hold lead frames 36*a* and 36*b* in a proper parallel isolated and secure orientation. Metallic conductors 54*a*, 54*b*, 54*c* and 54*d* of lead frame 36*b* are first formed around the lower surface 19 of second body half 14. Then, metallic conductors 52*a*, 52*b*, 52*c* and 54*d* of lead frame 36*a* are formed around the lower surface 19 of second body half 14. Metallic conductors 52*a*–52*d* and 54*a*–54*d* are formed around radius 35 on lower surface 19 of second body half 14, without the aid of any external tooling. Radius 35 acts as a mandrel around which metallic conductors 52*a*–52*d* and 54*a*–54*d* are formed and parallel channels 23*a*–23*h* form the recesses into which metallic conductors 52*a*–52*d* and 54*a*–54*d* are formed. Once formed, metallic conductors 52 and 54 are axially received within parallel channels 23*a* through 23*h* on lower surface 19 of second body half 14, and extend downwardly and rearwardly, thus being retained within parallel channels 23*a* through 23*h*. Once assembled, a portion of metallic conductors 52*a*–52*d* and 54*a*–54*d*, opposite that of the ends formed around radius 35 of lower surface 19 of second body half 14, remain unformed and extend axially through the assembled spring block extending outwardly from second surface 13 of first body half 12 and second surface 17 of second body half 14. These straight portions of metallic conductors 52*a*–52*d* and 54*a*–54*d* are disposed to be received within a printed wiring board during a higher level assembly operation. Transverse strips 56*a* and 56*b* are now removed allowing metallic conductors 52*a*–52*d* and 54*a*–54*d* to independently reside within parallel channels 23*a* through 23*h*.

This simple attachment operation lends itself to simplified manual assembly or a relatively simple continuous motion machine to automatically assemble the first and second body halves together.

It will be obvious to those skilled in the art that many modifications and variations may be made to the preferred embodiments of the present invention, as set forth above, without departing substantially from the principles of the present invention. For example, but not limited to the following, it is possible to implement the present invention with a variety of aperture size openings in order to accommodate electrical conductors of different sizes and profiles, or vary the shape and size of the projections of the first and second body halves in order to accommodate lead frames having metallic conductors of varying shapes, or it is possible to manufacture the snap together spring block with a varying number of projections and cavities in order to accommodate a varying number of metallic conductors while still practicing the concepts of the invention, as set forth previously. All such modifications and variations are intended to be included herein within the scope of the present invention, as defined in the claims that follow.

In the claims set forth hereinafter, the structures, materials, acts, and equivalents of all "means" elements and "logic" elements are intended to include any structures, materials, or acts for performing the functions specified in connection with said elements.

It is claimed:

1. A snap together spring block, comprising:

a first body half having an internal and external surface;

a second body half having an internal and external surface;

a plurality of cavities and projections on said internal surface of said first body half adapted to receive the metallic conductors of a lead frame;

a plurality of cavities and projections on said internal surface of said second body half adapted to receive the metallic conductors of a lead frame;

an internal attachment clip molded into said internal surface of said first body half and an internal attachment recess molded into said internal surface of said second body half for mating said first and second body halves; and a plurality of parallel channels formed in said external surface of said second body half adapted to receive said metallic conductors of said lead frame.

2. The block of claim 1, wherein said plurality of cavities and said plurality of projections are alternately spaced such that when said first body half is mated to said second body half, said projections are received within said cavities forming a plurality of apertures in a plurality of planes in which metallic conductors of said lead frame are supported in an alternating parallel orientation such that the metallic conductors remain rigidly fixed and electrically isolated from one another.

3. The block of claim 1, wherein said first and second body halves are constructed of a dielectric material.

4. The block of claim 1, wherein said plurality of projections and cavities extend longitudinally for the entire length of said first and second body halves, and are configured in a variety of profiles in order to accommodate various shaped lead frames.

5. The block of claim 1, wherein said plurality of channels on said external surface of said second body half extend longitudinally for the entire length of said second body half, and are configured to accommodate said metallic conductors of said lead frame.

6. The block of claim 1, wherein said internal attachment clip extends longitudinally for the entire length of said first body half.

7. The block of claim 1, wherein said internal attachment recess extends longitudinally for the entire length of said second body half.

* * * * *